US008036580B2

(12) United States Patent
Nogami et al.

(10) Patent No.: US 8,036,580 B2
(45) Date of Patent: Oct. 11, 2011

(54) POLYURETHANE FOAM TONER SUPPLYING ROLLER AND METHOD FOR MANUFACTURING THE SAME

(75) Inventors: Mie Nogami, Tsukuba (JP); Yoko Kato, Kashiwa (JP)

(73) Assignee: Canon Kasei Kabushiki Kaisha, Tsukuba-shi (JP)

( * ) Notice: Subject to any disclaimer, the term of this patent is extended or adjusted under 35 U.S.C. 154(b) by 717 days.

(21) Appl. No.: 12/128,138

(22) Filed: May 28, 2008

(65) Prior Publication Data

US 2008/0310887 A1 Dec. 18, 2008

(30) Foreign Application Priority Data

Jun. 12, 2007 (JP) ..... 2007-155000

(51) Int. Cl.
*G03G 15/08* (2006.01)

(52) U.S. Cl. ..... 399/281

(58) Field of Classification Search ..... 399/258, 399/272, 279, 281
See application file for complete search history.

(56) References Cited

U.S. PATENT DOCUMENTS

| | | | | |
|---|---|---|---|---|
| 5,768,668 | A | 6/1998 | Shiraki et al. | |
| 2008/0070147 | A1 * | 3/2008 | Uchino et al. | 430/111.1 |

FOREIGN PATENT DOCUMENTS

| | | | | |
|---|---|---|---|---|
| JP | 9-274373 | A | | 10/1997 |
| JP | 2001-9958 | A | | 1/2001 |
| JP | 2002-363237 | A | | 12/2002 |
| JP | 2002361649 | A | * | 12/2002 |
| JP | 2004-37630 | A | | 2/2004 |
| JP | 2004151499 | A | * | 5/2004 |

OTHER PUBLICATIONS

Machine English Translation of JP 2002-361649.*
Machine English Translation of JP 2004-151499.*

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

A toner supplying roller is provided in which a polyurethane foam layer can be obtained without decreasing the reactivity of the polyurethane material, and in which contamination by a catalyst remaining in the polyurethane foam layer is suppressed, so that a good image can be obtained. Moreover, the toner supplying roller has suitable aperture cells in the surface, suitably performs the scraping off of the development residual toner and toner supply between the toner supplying roller and the developing roller, and forms a uniform toner thin film on the developing roller, so that a good image can be obtained. In a toner supplying roller including a polyurethane foam layer that is formed on the mandrel periphery using a polyurethane material including a polyol and a polyisocyanate, the polyol and the polyisocyanate have an amine number of 3 mg KOH/g or more and 15 mg KOH/g or less in total.

2 Claims, 1 Drawing Sheet

POLYURETHANE FOAM TONER SUPPLYING ROLLER AND METHOD FOR MANUFACTURING THE SAME

BACKGROUND OF THE INVENTION

1. Field of the Invention

The present invention relates to a toner supplying roller provided in the developing apparatus of an image forming apparatus, such as a copying apparatus, an image recording apparatus, a printer and a facsimile, and a method for manufacturing the same.

2. Description of the Related Art

An image forming apparatus, such as a copying apparatus, an image recording apparatus, a printer and a facsimile, includes a developing apparatus that develops an electrostatic latent image formed on a latent image bearing member, such as a photosensitive member and an electrostatic recording dielectric. The developing apparatus includes a developer container that stores a toner (a developer), a developing roller that is provided with its part exposed from this developer container to block the opening of the developer container, and a developing blade that abuts the developing roller and forms a toner thin film having a constant thickness on the developing roller. The toner is friction charged when passing between the developing roller and the developing blade with the rotation of the developing roller, conveyed to the opposing latent image bearing member in the portion where the developing roller is exposed from the developer container, and moved to an electrostatic latent image having higher potential, for development.

In such a developing apparatus, a toner supplying roller that scrapes off the toner not used for the development of the electrostatic latent image and remaining on the surface of the developing roller and supplies a new toner in the developer container onto the developing roller is provided in the developer container. The development residual toner scraped off from the developing roller is mixed with the toner in the developer container, and the charge of the development residual toner is diluted and disappears.

This type of toner supplying roller needs to have low hardness or flexibility and the conveyance property that enables the conveyance of a large amount of the toner, to remove the development residual toner and supply a new toner smoothly between the toner supplying roller and the developing roller. Therefore, a polyurethane foam layer formed of a foamed elastic member, such as a polyurethane foam, or the like is provided on the surface of the toner supplying roller, as one that is flexible and has apertures. For example, a polyurethane foam in which toner supply to and toner scraping off from the developer carrier are uniform (Japanese Patent Application Laid-Open No. 2004-037630), a conductive polyurethane foam member having stable fine cells (Japanese Patent Application Laid-Open No. 2002-363237), a semiconductive charging member having stable electrical resistance (Japanese Patent Application Laid-Open No. 2001-009958), and the like are reported.

A toner supplying roller having a surface layer of such a polyurethane foam is manufactured by, for example, the following method. First, a polyol component, an isocyanate component, a foaming agent, a foam control agent, and a catalyst are mixed and stirred, and the mixture is injected into a molding die for a toner supplying roller. The mixture is foamed in the die, and then the molded product is mold released, so that a toner supplying roller can be manufactured (Japanese Patent Application Laid-Open No. H09-274373 (pages 8 to 9)).

In manufacturing such a polyurethane foam layer, amine catalysts and organometallic catalysts are used as a catalyst used for the polymerization and curing of the polyurethane material. Specifically, the amine catalysts can include triethylenediamine, bis(dimethylaminoethyl)ether and N,N,N',N'-tetramethylhexanediamine. The organometallic catalysts can include tin octylate, tin oleate, dibutyltin dilaurate, dibutyltin diacetate, tetra-i-propoxytitanium, tetra-N-butoxytitanium and tetrakis(2-ethylhexyloxy)titanium. Among these catalysts, the amine catalysts have advantages of good compatibility with water and longer toxicity and longer lifetime at the time of a premix than those of the organometallic catalysts. On the other hand, a large amount of the amine catalysts are used, and the amine catalysts may be a factor of image deterioration, for example, the amine catalyst remaining in the polyurethane foam layer gradually precipitates to contaminate a part, such as a developing roller, in contact with the toner supplying roller, and the toner.

SUMMARY OF THE INVENTION

An object of the present invention is to provide a toner supplying roller in which even if the amount of a catalyst used is decreased or no catalyst is used, a polyurethane foam layer can be obtained without decreasing the reactivity of the polyurethane material, and in which contamination by the catalyst remaining in the polyurethane foam layer is suppressed, so that a good image can be obtained. Moreover, the toner supplying roller has suitable aperture cells in the surface, suitably performs the scraping off of the development residual toner and toner supply between the toner supplying roller and the developing roller, and forms a uniform toner thin film on the developing roller, so that a good image can be obtained.

Another object of the present invention is to provide a method for manufacturing a toner supplying roller, which can form in the surface aperture cells that can suitably perform the scraping off of the development residual toner and toner supply between the toner supplying roller and the developing roller, and which moreover can manufacture efficiently.

The present inventors tried to use a polyurethane material containing a polyol having an amino group, and polyisocyanate having an amino group, or a prepolymer into which an amino group is introduced after a polyol and a polyisocyanate are turned into a prepolymer, in forming a polyurethane foam layer. The knowledge that these amino groups have catalyst function that can polymerize and cure these monomers was obtained. Therefore, the knowledge was obtained that no catalyst is used or the amount of a catalyst used can be reduced, and that moreover, even if no catalyst is used, a decrease in polymerization reactivity is suppressed, and a polyurethane foam layer having a surface having a suitable aperture ratio can be efficiently molded. The present invention was completed, based on these knowledges.

The present invention relates to a toner supplying roller including a polyurethane foam layer that is formed on the mandrel periphery using a polyurethane material including a polyol and a polyisocyanate, wherein the polyol and the polyisocyanate have an amine number of 3 mg KOH/g or more and 15 mg KOH/g or less in total.

Also, the present invention relates to a toner supplying roller including a polyurethane foam layer that is formed on the mandrel periphery using a polyurethane material including a polyol and a polyisocyanate, wherein the polyol has an amine number of 3 mg KOH/g or more and 15 mg KOH/g or less.

Also, the present invention relates to a method for manufacturing a toner supplying roller, including molding a polyurethane foam layer using a polyurethane material having a cream time of 6 seconds or more and 20 seconds or less.

In the toner supplying roller of the present invention, a polyurethane foam layer can be obtained without decreasing the reactivity and properties of the polyurethane material, while the amount of a catalyst used is decreased or no catalyst is used, and contamination by the catalyst remaining in the polyurethane foam layer is suppressed, so that a good image can be obtained. Moreover, the toner supplying roller has suitable aperture cells in the surface, suitably performs the scraping off of the development residual toner and toner supply between the toner supplying roller and the developing roller, and forms a uniform toner thin film on the developing roller, so that a good image can be obtained.

Also, in the method for manufacturing a toner supplying roller according to the present invention, aperture cells that can suitably perform the scraping off of the development residual toner and toner supply between the toner supplying roller and the developing roller can be formed in the surface, and moreover, the toner supplying roller can be efficiently manufactured.

Further features of the present invention will become apparent from the following description of exemplary embodiments with reference to the attached drawings.

BRIEF DESCRIPTION OF THE DRAWINGS

FIG. 1A is a top view, and FIG. 1B is a side view.

DESCRIPTION OF THE EMBODIMENTS

Figure 1A:
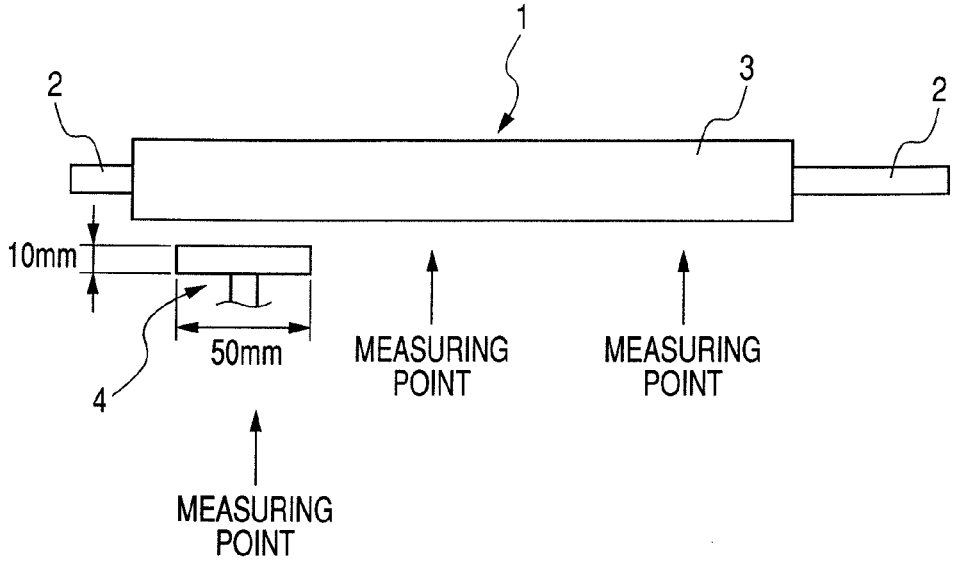
FIG. 1A and FIG. 1B are views illustrating a method for measuring the hardness of the polyurethane foam layer of a toner supplying roller.

The toner supplying roller of the present invention has a polyurethane foam layer that is molded on the mandrel periphery using a polyurethane material including a polyol and a polyisocyanate.

The polyurethane foam layer constituting the surface of the toner supplying roller of the present invention has low hardness and has the function of supplying a toner to a developer carrier, such as a developing roller, and scraping off the development residual toner remaining on the developing roller.

(Polyurethane Material)

The polyol and polyisocyanate included in the above polyurethane material have an amine number of 3 mg KOH/g or more and 15 mg KOH/g or less in total. The total amine number of the polyol and polyisocyanate can be 5 mg KOH/g or more and 14 mg KOH/g or less. If the amine number of the polyol and polyisocyanate included in the polyurethane material is 3 mg KOH/g or more, the amino group can function sufficiently as a catalyst. If the total amine number of the polyol and polyisocyanate is 15 mg KOH/g or less, the progress of polymerization reaction can be controlled, and the aperture ratio of the cells can be controlled. Also, it is not easy to manufacture a polyol having an amine number of 15 mg KOH/g or more.

The polyol component included in the polyurethane material can have the above amine number. If the polyol has the above amine number, the function of an amino catalyst can be more remarkably provided.

An amino group is introduced into the polyol and polyisocyanate to provide a polyol and a polyisocyanate having such an amine number. Amine that is introduced may be either primary amine or secondary amine. Such an amino group can include an amino group, a methylamino group and a dimethylamino group. These amino groups may not be introduced into the entire polyol and may be introduced into part of the polyol.

The polyol into which the above amino group is introduced can include, specifically, the following: polyethylene adipate, polybutylene adipate, polyhexylene adipate, a copolymer of ethylene adipate and butylene adipate, dimer acid polyol and castor oil polyol. Polyester polyol, such as polycaprolactone polyol, and polyether polyol, such as polyoxyalkylene glycol. Among these polyols, polyether polyol is suitable to obtain a polyurethane foam layer having excellent humidity and heat resistant durability. Further, polyether polyol in which 5 mole % or more of ethylene oxide (EO) is grafted at the end is favorable because of excellent reactivity. Also, commercial products, such as polymer polyol modified by polymerizing an ethylenically unsaturated monomer (such as acrylonitrile, styrene, methyl methacrylate and vinylidene chloride) in polyether polyol (manufactured by Mitsui Chemical Corporation), can also be applied. Using this polymer polyol as a part, improvement in air permeability, and the like, can be designed without decreasing the humidity and heat durability of the polyurethane foam.

These polyols preferably have a number average molecular weight of 1000 or more and 7500 or less, more preferably 3000 or more and 7500 or less. If the number average molecular weight of polyol is 1000 or more, sufficient crosslinking density is obtained, and a decrease in the properties of the obtained polyurethane foam layer, such as strength and elasticity, can be suppressed. If the number average molecular weight is 7500 or less, a polyurethane foam layer having sufficiently low hardness can be obtained.

The polyol having the above amine number can include polyol having an amine number of 0.1 mg KOH/g or less. When polyol contains such polyol having an amine number of 0.1 mg KOH/g or less, the number of functional groups and molecular weight can be easily controlled, so that the adjustment of each property is easy, therefore, a polyurethane foam layer having the desired properties can be obtained. As the polyol having an amine number of 0.1 mg KOH/g or less, specifically, a polyol that is similar to those illustrated as the above polyols and has no amino group as a substituent or has a low content of an amino group can be illustrated. Also for the molecular weight of polyol having an amine number of 0.1 mg KOH/g or less, a favorable range can include the range of molecular weight similar to the above.

The content of the polyol having an amine number of 0.1 mg KOH/g or less can be 5 mass % or more and 60 mass % or less, based on the total polyol. If the content of the polyol having an amine number of 0.1 mg KOH/g or less is 5 mass % or more, a polyurethane foam layer having sufficiently low hardness can be obtained. If the content is 60 mass % or less, a decrease in the polymerization reactivity of the polyurethane material can be suppressed.

Here, the amine number is expressed by the mg number of potassium hydroxide equivalent to hydrochloric acid required for neutralizing 1 g of polyol.

For the amine number, a value measured by the following measurement method can be adopted. Specifically, a value measured using a mixed solvent of ethanol:toluene=1:4 as a diluent, and a 0.1 M hydrochloric acid/ethanol solution as a titrant, and using a potentiometric titration apparatus (AT-510 manufactured by Kyoto Electronics Manufacturing Co., Ltd.) can be used.

The above polyol can also be used as a prepolymer previously reacted with polyisocyanate.

The polyisocyanate used in the above polyurethane material, together with the above polyol, have an amine number of 3 mg KOH/g or more and 15 mg KOH/g or less in total. When polyol has an amine number of 3 mg KOH/g or more and 15 mg KOH/g or less, polyisocyanate may not have an amino group, that is, may have an amine number of 0. Various polyisocyanates can be used, and polyisocyanate can include, specifically, the following: aromatic polyisocyanate, such as polymethylene polyphenyl polyisocyanate (Polymeric MDI), diphenylmethane diisocyanate (MDI) and toluene diisocyanate (TDI). Aliphatic polyisocyanate, such as hexamethylene diisocyanate, and alicyclic polyisocyanate, such as isophorone diisocyanate, and derivatives thereof. One of these, or two or more of these in combination can be used.

The number average molecular weight of polyisocyanate can be 174 or more and 7500 or less. If the number average molecular weight is 7500 or less, it can be suppressed that polyisocyanate has high viscosity and is difficult to handle.

For the content of the polyol and polyisocyanate in the polyurethane material, the content of polyol can be in a range of 60% or more and 130% or less, and preferably 70% or more and 115% or less, as an isocyanate index.

The isocyanate index is expressed by the equivalent ratio of an NCO group to an active hydrogen group involved in reaction with isocyanate (the equivalent of the NCO group/the equivalent of the active hydrogen group)×100.

The polyurethane material may contain additives in a range that does not inhibit the function of the above substances. As additives, a catalyst, a foaming agent and a foam control agent, as well as a crosslinking agent, a flame retardant, a colorant, an ultraviolet absorber, an age resister, an antioxidant, a conductivity providing agent and the like can be used as required.

As the catalyst, amine compounds, organometallic compounds and the like can be used. The catalyst can include, specifically, the following: triethylenediamine, bis(dimethylaminoethyl)ether, N,N,N',N'-tetramethylhexanediamine, N-ethylmorpholine, and N,N-dimethylaminohexanol. One of these, or a combination of these can be used. These catalysts are favorable because the amount of the residual catalyst in the polyurethane foam layer being small can suppress that the catalyst precipitates from the polyurethane foam layer as the polyurethane foam layer is used for image formation. The amount of the catalyst used can be 0.4 mass % or less in the polyurethane material. If the content of the catalyst is 0.4 mass % or less, precipitation from the polyurethane foam layer is suppressed, so that the occurrence of a poor image due to contamination can be suppressed.

As the above blowing agent, water, chlorofluorocarbons (such as HFC-134A), hydrocarbons (such as cyclopentane), carbon dioxide gas and the like can be used. These may be used in combination. Among these, water is suitable because water is a good-quality foaming agent that reacts with polyisocyanate to form polyurea and produce carbon dioxide, which is a foaming agent, and the handling of water is easy. The amount of water used as a foaming agent can be 0.1 parts by mass or more and 10 parts by mass or less, and more preferably 0.1 parts by mass or more and 5 parts by mass or less, based on 100 parts by mass of polyol.

The above foam control agent is used for the stabilization of foam cells. For example, the following can be used: water-soluble polyether siloxane from polydimethylsiloxane and an EO (ethylene oxide)/PO (propylene oxide) copolymer, sodium salts of sulfonated ricinoleic acid, and a mixture of these and a polysiloxane-polyoxyalkylene copolymer. Among these, water-soluble polyether siloxane from polydimethylsiloxane and an EO/PO copolymer is suitable. The amount of the foam control agent used is suitably 0.01 parts by mass or more and 5 parts by mass or less with respect to 100 parts by mass of polyol. If the amount of the foam control agent used is 0.01 parts by mass or more with respect to 100 parts by mass of total polyol, uniform foam cells are easily formed. If the amount of the foam control agent used is 5 parts by mass or less, leaching from the polyurethane foam layer can be suppressed.

(Polyurethane Foam Layer)

The above polyurethane foam layer is formed using the above polyurethane material, and the aperture ratio of the surface can be 50% or more and 90% or less. The cells that the polyurethane foam layer has should be such that the aperture ratio of the surface is in the above range. The cells may be mutually communicated, or each cell may be independent. The aperture ratio of the cells is, when the surface of the polyurethane foam layer is assumed as a smooth surface, the ratio of the area of the aperture portion present in the smooth surface to the area of the smooth surface. If the aperture ratio is 50% or more, a constant amount of the toner can be conveyed, and a constant amount of the toner can be stably supplied to the developing roller. If the aperture ratio is 90% or less, such polyurethane foam layer can be easily manufactured.

Methods for forming the above polyurethane foam layer with the aperture ratio of cells in the above range can include a method for adjusting the amine number of polyol and polyisocyanate in the above range, and a method for adjusting the amount and foaming degree of the foaming agent and the foam control agent.

Here, for the aperture ratio, an image on the surface is captured using a real-time scanning laser microscope (manufactured by Lasertec Corporation, 1LM21DW-1) and is binarized by image analysis, and the cell aperture ratio [%] can be obtained by the following formula:

$$\text{cell aperture ratio [\%]} = \text{cell aperture area/image range} \times 100$$

The density of the above polyurethane foam layer can be 0.05 g/cm$^3$ or more and 0.3 g/cm$^3$ or less. In order to manufacture a polyurethane foam layer having such a density, the amount of the foaming agent and foam control agent used should be adjusted, and the degree of physical foaming should be adjusted when physical foaming is used.

The hardness of the above polyurethane foam layer can include, for example, 50 g/mm or more and 350 g/mm or less. By having such a hardness, the delivery of the toner can be performed well between the toner supplying roller and the developing roller.

Figure 1B:
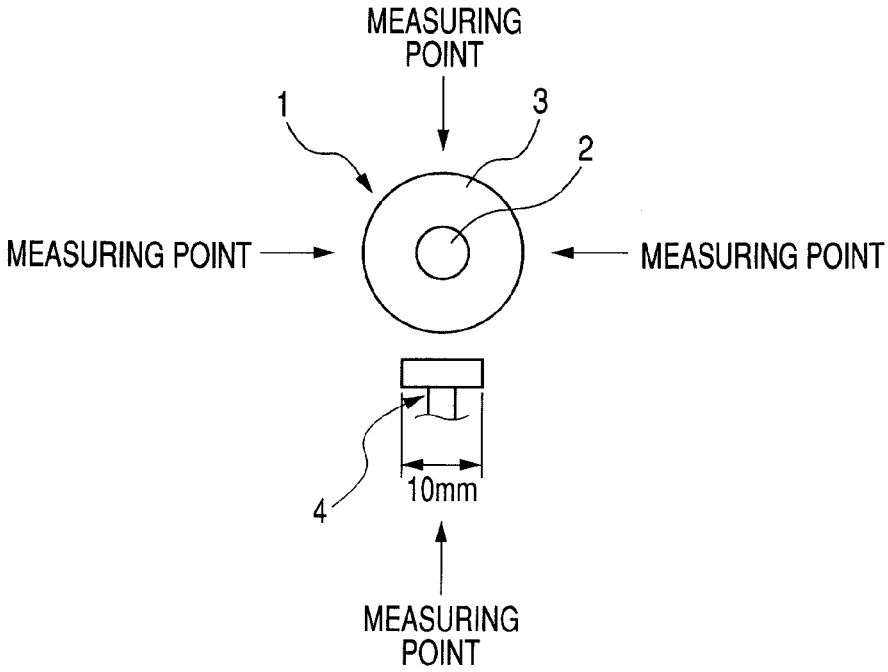

For the hardness of the polyurethane foam layer, a value measured by the following measurement method can be adopted. As illustrated in FIGS. 1A and 1B, a toner supplying roller 1 is supported by a mandrel 2 at the both ends of the toner supplying roller 1. When a polyurethane foam layer 3 is pressed by a jig 4 having a 50 mm long (the longitudinal direction of the roller)×10 mm wide (thickness: 10 mm) plate-like press surface at a speed of 10 mm/min, load (g) at a displacement (compression) of 1 mm is measured. The measuring points are three points in the axial direction and four points for each 90 degrees in the circumferential direction in each axial direction, 12 points in total, as illustrated. The average value of the measuring points is defined as hardness. As the value increases, it is indicated that the polyurethane foam layer 3 is harder.

The thickness of the above polyurethane foam can include, for example, 3 mm or more and 20 mm or less. By having such a thickness, excellent toner conveyance property can be provided.

(Toner Supplying Roller)

The toner supplying roller of the present invention should have a mandrel and the above polyurethane foam layer on the mandrel periphery. The mandrel should have strength that can support the polyurethane foam layer provided on the mandrel periphery. The material for the mandrel can include metal, such as iron, aluminum and stainless steel, and resin. A mandrel of metal may be rustproofed. The shape of the mandrel can include cylindrical and columnar shapes, for example, an outer diameter of 4 mm or more and 10 mm or less.

Further, in addition to these, a skin layer having the above aperture ratio can also be provided on the periphery of the polyurethane foam layer, and functional layers that can provide various functions to the toner supplying roller can also be provided under the polyurethane foam layer.

(Method for Manufacturing Toner Supplying Roller)

A method for manufacturing the above polyurethane foam is a method for manufacturing the above toner supplying roller, including molding a polyurethane foam layer using a polyurethane material having a cream time of 6 seconds or more and 20 seconds or less.

As the method for manufacturing a toner supplying roller according to the present invention, a polyurethane material having a cream time of 6 seconds or more and 20 seconds or less is used to mold a polyurethane foam layer. The above cream time is an indicator of the reaction speed of the polyurethane material, and the aperture ratio of the cells in the surface can be adjusted by the cream time. If the cream time is 6 seconds or more, the polymerization reaction proceeds, so that molding can be performed efficiently. If the cream time is 30 seconds or less, the progress of the polymerization reaction is controlled, so that a polyurethane foam layer having good shape and the like can be obtained. The cream time is more preferably 7 seconds or more and 17 seconds or less. The cream time can be adjust in the above range by adjusting the reaction temperature, raw material temperature, stirring conditions, catalyst type and the like.

Here, the cream time can be, specifically, time measured by the following measurement method. In an environment of a room temperature of 25±3° C., all of the polyurethane material, except for polyisocyanate, that is, polyol and other additives, such as a catalyst, a foam control agent, a foaming agent and a crosslinking agent, are measured into a cup having an internal volume of 500 milliliters, and lastly polyisocyanate is added. The amount of polyol added is 50 g, and the amount of other additives added is based on the amount of polyol added. After polyisocyanate is added and stirring is performed for 5 seconds at 2000 to 3500 rpm, stirring is stopped. From a point at which stirring is started, time at which the polyurethane material becomes creamy and white and begins to foam is measured, and this time is cream time.

One example of molding a polyurethane foam layer using such a polyurethane material is as follows. First, the above polyol, polyisocyanate and a foaming agent, and a foam control agent, a catalyst, other aids and the like as required are homogeneously mixed to prepare a polyurethane material. There are a method in which this polyurethane material is injected into a mold, such as a pipe die and a split die, (the molding cavity in a molding die), in which a mandrel is provided, for foaming and curing, a method in which this polyurethane material is molded into a predetermined shape, such as a plate shape or a cylindrical shape, and then adhered to a mandrel, and the like. An adhesive layer can be provided between the mandrel and the polyurethane foam as required in either method. As this adhesive layer, publicly known materials, such as an adhesive and a hot melt sheet, can be used. The method for molding a polyurethane foam layer can be particularly a method in which a polyurethane material is injected into the molding cavity in a molding die, in which a mandrel is arranged, to mold a polyurethane foam layer.

The temperature and time in preparing a polyurethane material are not particularly limited. For example, the mixing temperature can include a range of 10° C. or more and 90° C. or less and preferably 20° C. or more and 60° C. or less, and the mixing time can include 1 second to 10 minutes and preferably about 3 seconds to 1 minute.

Also, the foaming method is not particularly limited, and any method, such as a method using a foaming agent, and a method in which bubbles are mixed by mechanical stirring, can be used. The foaming ratio can be appropriately determined.

By polishing the polyurethane foam layer bonded around the mandrel, aperture cells having the above aperture ratio can be formed in the surface, and the polyurethane foam layer can be molded into a predetermined size.

EXAMPLES

The toner supplying roller of the present invention will be specifically described below, but the technical range of the present invention is not limited to these.

The raw materials used are shown below.

(1) polyol 1: polyether polyol (DVV6340 manufactured by The Dow Chemical Company) having an OH value of 32 and an amine number of 13.5 mg KOH/g.

(2) polyol 2: polyether polyol (ACTCOL EP-828 manufactured by Mitsui Chemicals Polyurethanes, Inc.) having an OH value of 28 and an amine number of 0 mg KOH/g.

(3) polyisocyanate: Cosmonate TM50 manufactured by Mitsui Chemicals Polyurethanes, Inc., NCO=39.8%.

(4) a foam control agent: a silicone foam control agent (SRX-274C manufactured by Dow Corning Toray Co., Ltd.)

(5) catalyst 1: an amine catalyst (TOYOCAT-ET manufactured by Tosoh Corporation)

(6) catalyst 2: an amine catalyst (L33 manufactured by Tosoh Corporation)

Examples 1 to 4 and Comparative Examples 1 to

A cylindrical SUS metal die in which a chemically nickel-plated iron mandrel having a diameter of 5 mm and a length of 266 mm was arranged, was prepared, and the temperature of the metal die was adjusted to 50° C.

On the other hand, the catalysts and foam control agent shown in Table 1 were measured respectively, based on 100 parts by mass of polyol as the polyol component. The polyol, the foam control agent, the catalysts and water were mixed and stirred, and adjusted to 25° C. Polyisocyanate, the temperature of which was adjusted to 25° C., was added to the obtained mixture. The mixture was stirred and mixed for 5 seconds and then injected into the metal die, which was placed in an electric furnace heated to 50° C., for foaming and curing for 20 minutes to prepare a polyurethane foam roller having an outer diameter of 14 mm. The length of the polyurethane foam layer was 22 cm, and the density of the polyurethane foam layer was 0.1 g/cm$^3$.

(Moldability)

The moldability was evaluated for the obtained toner supplying roller according to the following standard. The result is shown in Tables 1 and 2.

A: Defects, such as cracks, are not observed during mold release, and the roller shape after mold release is maintained.

B: Defects, such as cracks, are slightly observed during mold release, or the deformation of the roller shape after mold release is slightly observed.

C: Defects, such as cracks, are clearly observed during mold release, and the deformation of the roller shape after mold release is clearly observed.

(Image Evaluation)

The obtained toner supplying roller was incorporated into a cartridge and stored in an environment of a temperature 40° C. and a humidity of 95% for one month. Then, durable image evaluation was performed using a laser beam printer (hp color Laser Jet 4600 manufactured by Hewlett-Packard Japan, Ltd.).

5000 sheets were printed. The image density, and uniformity in image quality were observed, and the image was evaluated according to the following standard. The result is shown in Table 1.

A: a good image in which no defects are observed.

B: an image in which signs of defects are slightly observed.

C: an image in which defects are clearly observed.

TABLE 1

| | Example 1 | Example 2 | Comparative Example 1 | Comparative Example 2 | Comparative Example 3 | Example 3 | Example 4 | Comparative Example 4 |
|---|---|---|---|---|---|---|---|---|
| Polyol 1 (parts by mass) | 100 | 100 | — | — | 100 | 70 | 20 | 5 |
| Polyol 2 (parts by mass) | — | — | 100 | 100 | — | 30 | 80 | 95 |
| Polyisocyanate (parts by mass) | 34.6 | 34.6 | 35.3 | 35.3 | 34.6 | 34.8 | 35.2 | 35.3 |
| Foam Control Agent (parts by mass) | 1 | 1 | 1 | 1 | 0.3 | 1 | 1 | 1 |
| Catalyst 1 (parts by mass) | 0 | 0.01 | 0.3 | 0.01 | 0 | 0.01 | 0.01 | 0.01 |
| Catalyst 2 (parts by mass) | 0 | 0.01 | 0.3 | 0.01 | 0.3 | 0.01 | 0.01 | 0.01 |
| Total Amine Number (mgKOH/g) | 13.5 | 13.5 | 0 | 0 | 13 | 9 | 3 | 0.7 |
| Cell Aperture Ratio (%) | 85 | 77 | 73 | 78 | 48 | 81 | 83 | 80 |
| Cream Time (seconds) | 7 | 6 | 5 | 13 | 6 | 7 | 11 | 13 |
| Moldability | A | A | C | C | A | A | B | C |
| Image Evaluation Result | A | A | C | A | C | A | A | A |

In Examples 1 to 4, a good image was obtained. In Comparative Example 1 including 0.6 parts by mass of the catalysts with respect to 100 parts by mass of polyol, blank areas in the image occurred by the contamination of the developing roller due to catalyst volatilization, the cream time was short, and molding was also difficult. In Comparative Example 3 having a cell aperture ratio of less than 50%, density unevenness in the solid black image occurred. In Comparative Examples 2 and 4, the image evaluation was good, but the moldability was bad, and after mold release, the roller shape deformed and was difficult to maintain.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Laid-Open No. 2007-155000, filed Jun. 12, 2007, which is hereby incorporated by reference herein in its entirety.

What is claimed is:

1. A toner supplying roller comprising a polyurethane foam layer formed on a mandrel periphery using a polyurethane material that has a polyol component and a polyisocyanate component, wherein the polyol component includes a polyol having an amine number of 0.1 mg KOH/g or less, and wherein the polyol component and the polyisocyanate component have an amine number of 3 mg KOH/g or more and 15 mg KOH/g or less in total.

2. A toner supplying roller comprising a polyurethane foam layer is formed on a mandrel periphery using a polyurethane material that has a polyol component and a polyisocyanate component, wherein the polyol component includes at least two polyols, one a polyol having an amine number of 0.1 mg KOH/g or less, and wherein the polyol component has an amine number of 3 mg KOH/g or more and 15 mg KOH/g or less in total.

* * * * *